US006929110B2

(12) United States Patent
Dobbins et al.

(10) Patent No.: US 6,929,110 B2
(45) Date of Patent: Aug. 16, 2005

(54) COIN CHUTE WITH OPTICAL COIN DISCRIMINATION

(75) Inventors: Bob M. Dobbins, Villanova, PA (US); Christian F. Dungan, Marlton, NJ (US); Aaron H. Dobbins, Villanova, PA (US)

(73) Assignee: Ellenby Technologies Inc., West Deptford, NJ (US)

( * ) Notice: Subject to any disclaimer, the term of this patent is extended or adjusted under 35 U.S.C. 154(b) by 59 days.

(21) Appl. No.: 10/247,888

(22) Filed: Sep. 20, 2002

(65) Prior Publication Data

US 2004/0045788 A1 Mar. 11, 2004

Related U.S. Application Data

(60) Provisional application No. 60/408,551, filed on Sep. 5, 2002.

(51) Int. Cl.[7] ..... G07D 5/02

(52) U.S. Cl. ..... 194/334; 194/203; 194/344; 356/635; 356/638; 356/639

(58) Field of Search ..... 33/27; 356/635, 356/638, 639; 194/324, 334, 337, 345–347

(56) References Cited

U.S. PATENT DOCUMENTS

| | | | | | |
|---|---|---|---|---|---|
| 4,089,400 | A | * | 5/1978 | Gregory, Jr. | 194/329 |
| 4,629,051 | A | * | 12/1986 | Abe | 194/261 |
| 4,899,061 | A | * | 2/1990 | Van Hoek et al. | 250/559.08 |
| 5,346,049 | A | * | 9/1994 | Nakajima et al. | 194/328 |
| 5,542,520 | A | * | 8/1996 | Beisel et al. | 194/335 |
| 6,049,386 | A | * | 4/2000 | Stringer et al. | 356/634 |
| 6,412,620 | B1 | * | 7/2002 | Imura | 194/317 |
| 6,431,342 | B1 | * | 8/2002 | Schwartz | 194/346 |
| 6,467,604 | B1 | * | 10/2002 | Wood et al. | 194/317 |

* cited by examiner

*Primary Examiner*—Donald P. Walsh
*Assistant Examiner*—Jeffrey A. Shapiro
(74) *Attorney, Agent, or Firm*—Priest & Goldstein

(57) ABSTRACT

Systems and techniques for providing an improved coin acceptor are described. In one aspect, an electronic coin acceptor exaggerates relatively small differences in coin diameters. A coin deposited into the coin acceptor passes along a coin path through two sensing beams, with at least one of the beams positioned at a nonperpendicular angle to the coin path. Timing information relating to the coin's passage through the beams is recorded and utilized to identify the coin. In another aspect, the thickness of the coin is determined as the coin passes through the sensing beams.

18 Claims, 10 Drawing Sheets

FIG. 8

800

| | dime | penny | nickel | quarter | dollar | Penny /dime | Nickel /penny | Quarter /nickel | dollar/ quarter |
|---|---|---|---|---|---|---|---|---|---|
| Actual | 17.91 | 19.05 | 21.21 | 24.26 | 26.50 | 1.06 | 1.11 | 1.14 | 1.09 |
| D1/D2 Perpendicular measurements D2=(in mm) D2 = 12.5 | 1.43 | 1.52 | 1.70 | 1.94 | 2.12 | 1.06 | 1.11 | 1.14 | 1.09 |
| D1/D2 45 degree angles.W = (in mm) | | | | | | | | | |
| W = 12.7 | 3.38 | 4.24 | 7.16 | 30.09 | 34.06 | 1.25 | 1.69 | 4.20 | -1.13 |
| W = 15.24 | 2.01 | 2.36 | 3.24 | 5.52 | 9.41 | 1.17 | 1.37 | 1.70 | 1.71 |
| W = 17.78 | 1.43 | 1.63 | 2.09 | 3.04 | 4.14 | 1.14 | 1.28 | 1.45 | 1.36 |
| W = 20.32 | 1.11 | 1.25 | 1.54 | 2.09 | 2.65 | 1.12 | 1.24 | 1.36 | 1.27 |
| W = 27 | 0.70 | 0.77 | 0.91 | 1.15 | 1.36 | 1.10 | 1.19 | 1.26 | 1.18 |

FIG. 9

900

| | dollar | quarter | nickel | penny | dime | penny /dime | nickel /penny | nickel /quarter | dollar /quarter | dollar/ nickel |
|---|---|---|---|---|---|---|---|---|---|---|
| T2 | 2.00 | 1.75 | 1.95 | 1.55 | 1.35 | 1.15 | 1.26 | 1.11 | 1.14 | 1.03 |
| T2/T1 T1= 3.5 | 0.57 | 0.50 | 0.56 | 0.44 | 0.39 | 1.15 | 1.26 | 1.11 | 1.14 | 1.03 |
| (T2-offset) /T1 with offset= 1 | 0.29 | 0.21 | 0.27 | 0.16 | 0.10 | 1.57 | 1.73 | 1.27 | 1.33 | 1.05 |

COIN CHUTE WITH OPTICAL COIN DISCRIMINATION

CROSS-REFERENCE TO RELATED APPLICATION

The present application claims the benefit of U.S. Provisional Application Ser. No. 60/408,551 entitled "Coin Chute With Optical Coin Discrimination" and filed Sep. 5, 2002 which is incorporated by reference herein in its entirety.

FIELD OF THE INVENTION

The present invention relates generally to improvements in low cost electronic coin acceptors. More particularly, the present invention relates to improvements in low cost electronic coin acceptors that provide for enhanced coin discrimination, reduced cost, and ease of assembly.

BACKGROUND OF THE INVENTION

There are many applications requiring very low cost coin acceptors such as amusement games, small vending machines and the like. Generally these applications are extremely price sensitive and cannot afford the cost of electronic coin acceptors. These applications generally do not require the payback of change. Hence, they do not require coin changers which are very expensive (hundreds of dollars for the lowest end product). In most cases, this market is served by mechanical coin acceptors which are very inexpensive but suffer from frequent failures due to the number of moving parts used. Electronic coin acceptors have also been used, but most of these are settable for only a single coin type. These electronic coin acceptors are significantly more expensive than the mechanical acceptors and if more than one coin type is required, multiple units need to be used. Of course, higher end coin acceptors are available usually at significantly higher prices as the recognition technology involves multiple sensors to determine multiple parameters of a coin. In these cases, the acceptors are designed for a high level of discrimination and false coin rejection.

Traditionally, electronic coin recognition has depended on inductive circuits involving multiple coils mounted with great precision along the path the coin is expected to roll. Additionally, it is well known in the art to use two coils, one on each side of the coin path, to measure such parameters as the thickness of the coin. The cost of these components are relatively high, and in combination with the cost of the supporting electronics required to drive these coils, this technology is not suitable for the mechanical coin acceptor replacement market.

As discussed above, the current technology is such that in order to obtain additional parameters of the coin being tested, additional sensors are required. Multiple parameter measurements without adding additional sensors have been disclosed in the art, but not without penalty. These solutions require customized inductive pot cores or increased electronic hardware costs. Neither of these options allows this class of solution to offer a suitable mechanical coin acceptor alternative.

The prior art discloses a number of optical solutions to the coin recognition challenge. These solutions have not been commercially successful since the resolution of the measurements are not sufficient to allow the required coin discrimination and false coin rejection required even in the most benign of applications. An example is the separation of United States (US) dimes and pennies. The diameter difference between these two coins is about 6%. This separation is reduced by the tolerance variations of each of the coins, the resolution of the measurements, coin bounce and the like. In order to achieve a high resolution of dime acceptance, a number of pennies are likely to be accepted as a dime.

The acceptance rate of coins also depends on having the coins rolling or sliding smoothly as they pass the measuring sensors. There are a number of techniques used to help achieve this coin control. It is known in the art to use snubbers to absorb the energy from the coin in an effort to have the coin continue along its path with a minimum of bounces and at a relatively constant speed. Unfortunately, these snubbers have been made from ceramic materials or formed metals, both of which are relatively expensive. Additionally, the effects of the snubbers are often determined by how well these components are mounted to the coin paths. Of course any bounce in the coins or speed variations in the coins as they pass the measuring sensors will result in errors in the measurements taken. These errors are a significant source of the variations seen for any given measurement and result in a wider range of sensors readings that must be included to ensure a high acceptance level.

To further add to the challenge of achieving a high acceptance rate of desired coins while rejecting similar sized but lower value undesired coins (such as pennies and Canadian coins in the US, for example), many higher end coin acceptors include material sensors to make these distinctions. These material sensors are typically additional inductive coils which add cost and complexity to the coin acceptor.

Another requirement of coin acceptors is to prevent "stringing" as a cheat method. Stringing is the technique whereby a string or tape is attached to the coin. When the coin passes through the sensors and is correctly credited, the string or tape is pulled to withdraw the coin through the entry point. There are a number of techniques in the current state of the art to prevent "stringing". Most of these involve the use of mechanical devices to catch the string or trap the coin if someone tries to pull it back. Most of these techniques again require additional components to achieve this function.

SUMMARY OF THE INVENTION

It is an object of one aspect of the current invention to provide a low cost diameter measurement system that has the effect of exaggerating relatively small differences in coin diameters.

It is a further object of one aspect of the current invention to provide a low cost thickness measurement system that has the effect of exaggerating relatively small differences in coin thickness.

It is yet another object of the current invention to provide both a low cost diameter and low cost thickness measurement system using a common sensor set.

It is also an object of the current invention to provide both diameter and thickness measurements systems using two pairs of low cost optical sensors.

It is a further object of the current invention to provide an electronic circuit arrangement which includes the optical components in a closed loop feedback system to eliminate the need to make any adjustments to the system.

It is another object of the current invention to provide a low cost technique to capture magnetic coins and material to avoid their false acceptance as valid coins.

Another object of the current invention is to provide a means to ensure the coin is under excellent control to ensure no coin bounce and relatively constant coin velocity without the use of snubbers.

It is yet another object of the current invention to provide an inherent method to eliminate coin stringing without the use of additional components.

Other features and advantages of the present invention are described further below and will be readily apparent by reference to the following detailed description and accompanying drawings.

BRIEF DESCRIPTION OF THE DRAWINGS

FIG. 8 shows a spreadsheet illustrating the results of the optical exaggeration diameter measurement techniques of the current invention;

FIG. 9 shows a spreadsheet illustrating the results of the optical exaggeration thickness measurement techniques of the current invention;

DETAILED DESCRIPTION

The present invention now will be described more fully with reference to the accompanying drawings, in which a preferred embodiment of the invention is shown. This invention may, however, be embodied in various forms and should not be construed as limited to the embodiment set forth herein. Rather, this embodiment is provided so that this disclosure will be thorough and complete, and will fully convey the scope of the invention to those skilled in the art.

Figure 1:
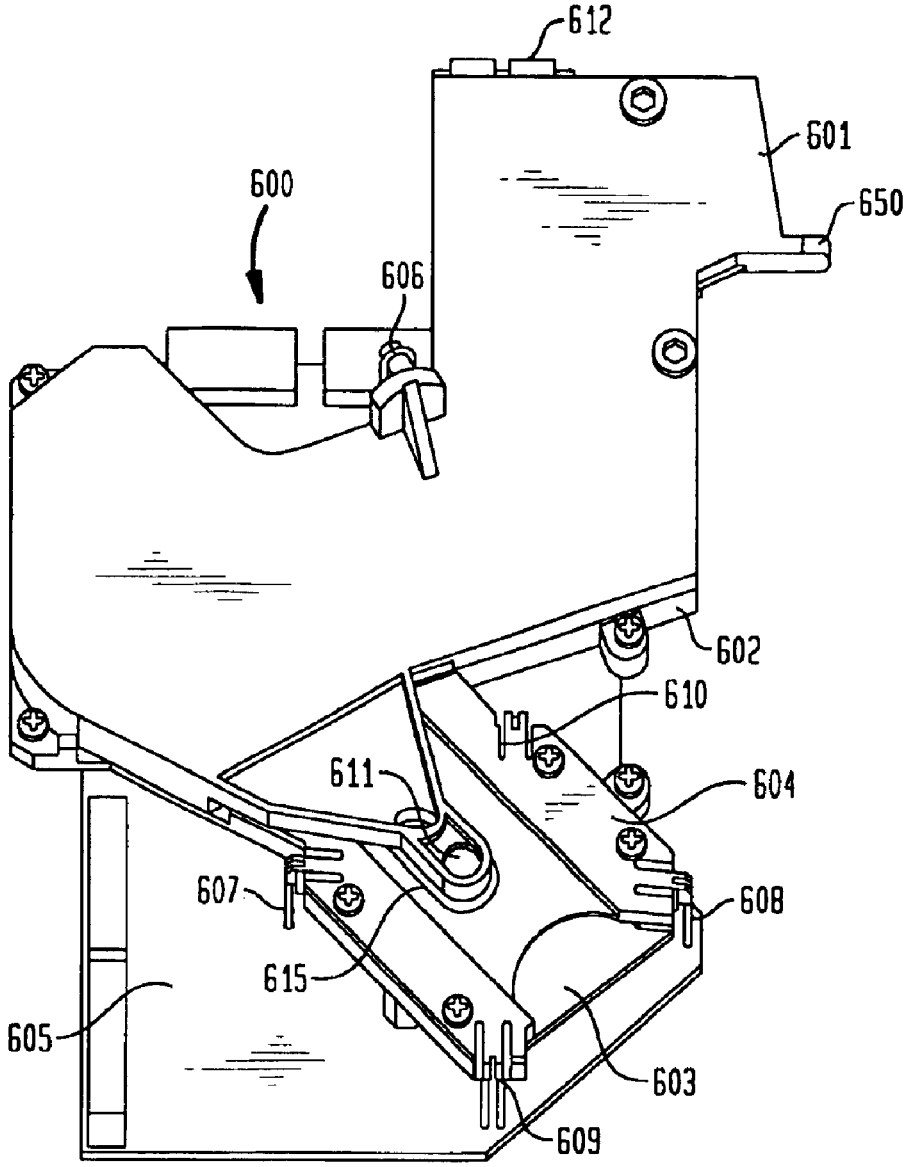
FIG. 1 shows a side perspective view of the coin chute of a presently preferred embodiment of the present invention.

As seen in FIG. 1, a coin chute 600 in accordance with the present invention includes a coin entry section at the top of an upper cover 601, and a coin exit section at the bottom of a lower slide 603. Optical transmitters and receivers positioned across the coin path operate as recognition sensors, as described in greater detail below. One such pair of sensors is shown as transmitter 608 and receiver 607, a second pair is transmitter 610 and receiver 609. In a preferred embodiment, these transmitters are low cost infra-red (IR) light emitting diodes (LEDs). An example of a suitable transmitter is the QT QED123 IR LED. Likewise, the receivers can be IR sensitive phototransistors such as the QT QSD123 IR Phototransistors.

Figure 3:
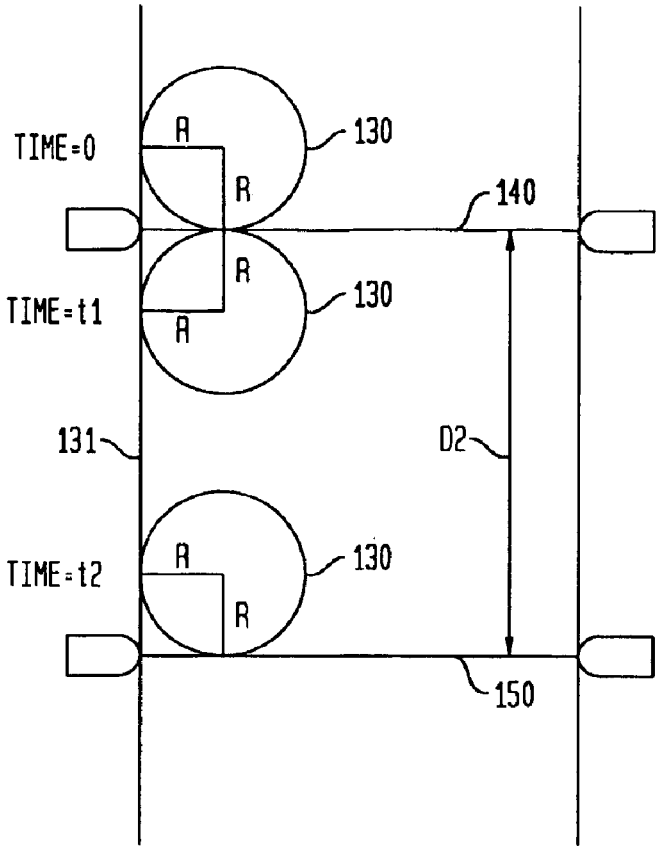
FIG. 3 illustrates an optical diameter measurement system without using an optical exaggeration technique.

It is known in the art that in order to measure the size of a moving object such as a coin rolling on a controlled path, the time it takes the coin to travel through a beam of light can be used so long as the velocity of the moving coin is known. As shown in FIG. 3, for a known velocity, the distance a coin 130 travels from when it first crosses a light beam 140 to when it completely exits the light beam 140 is the diameter of the coin, as the light beam 140 is perpendicular to the coin path 131. Note the radius R of coin 130 is the distance from the perpendicular beam 140 to the center of the coin 130 at time=0. The coin 130 travels through the beam until it is a distance again of radius R on the down side of the beam 140 at time=$t_1$, as shown in FIG. 3. The total distance traveled is 2×R, or the diameter of the coin. The diameter of the coin (in this case $D_1$) would be determined by the formula:

$$D_1=vt_1$$

Where $D_1$=distance traveled v=velocity of the moving object (coin)

$t_1$=time to travel the distance $D_1$

In the case of the example shown in FIG. 3, the distance traveled, which is the diameter of the coin as discussed above, is the velocity of the coin multiplied by the time the coin took to pass through the beam. The time would be determined by measuring electronically the duration the beam was interrupted. This measurement will be discussed further below. Unfortunately, the velocity is not generally known, so an additional measurement is required to determine the distance independent from the velocity. Referring again to FIG. 3, a second light beam 150 perpendicular to the coin path 131 is shown. Taking a second time measurement electronically from the time the coin crosses the first perpendicular light beam 140 at time=0 to the time the same coin first crosses the second light beam 150 at time=$t_2$ will determine the distance between the two light beams according to the following equation:

$$D_2=vt_2$$

Where $D_2$=distance traveled between the two perpendicular light beams v=velocity of the moving object (coin)

$t_2$=time to travel the distance $D_2$

As the coin 130 is traveling over a relatively short distance in total, the velocity in each of these measurements can be assumed to be constant. Therefore, the velocity is determined to be either of:

$$v=D_1/t_1,\ v=D_2/t_2$$

Or, by equivalence:

$$D_1/t_1_D_2/t_2$$

Thus it can be seen that the velocity component is eliminated from the equations leaving the relationship:

$$D_1/D_2=t_2/t_1$$

For a given distance $D_2$, measuring the times $t_2$ and $t_1$ will result in the determination of the coin diameter $D_1$. This relationship is true so long as the coin is rolling at a constant velocity. The velocity can vary depending on the properties of the particular coin, but it is assumed constant for the coin under test.

Controlling the coin along the path will ensure constant velocity. Further details of controlling the coin along the coin path are described below. In the example discussed above, the use of perpendicular sensor beams to measure the diameter of coins is limited in practice. There are a number of factors that make this technique impractical as a means for distinguishing coins having small diameter differences. These factors include measuring resolution, coin bounce, normal coin tolerance and the like. As an example, the diameter difference between US dimes and US pennies is about 6%. The statistical result of measurements of large numbers of dimes and pennies using low cost sensors, electronics and mechanical components result in poor discrimination between these coins. Clearly, slugs and other objects similar in diameter would be accepted incorrectly as a coin whose diameter is close to the object measured, resulting in a high rate of acceptance of false coins in order to ensure a high rate of acceptance of the true coins. Additional sensors are traditionally required to achieve acceptable coin recognition even in low cost products.

Figure 4:
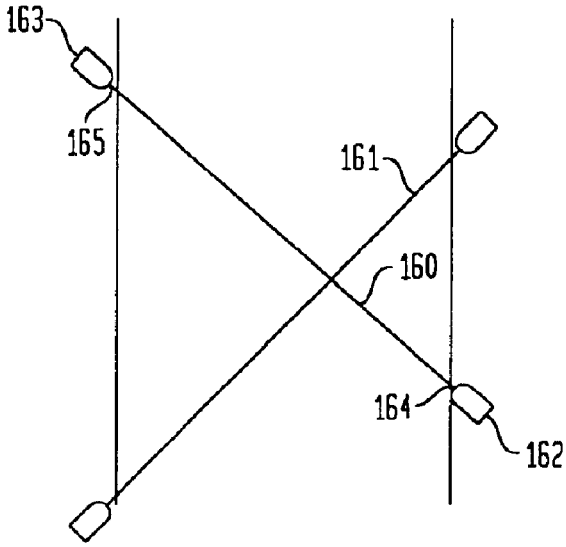
FIG. 4 illustrates an optical diameter measurement system using the optical exaggeration technique of the current invention.

The present invention seeks to substantially improve the acceptance of true coins while minimizing the acceptance of false coins. The current invention will also discriminate between dimes and pennies with at least a statistical 3-sigma separation. The present technique optically exaggerates the measured "distance". The calculated distance measurement $D_1$ is increased (exaggerated) and the $D_2$ measurement decreased (minimized). Thus, the ratio of $D_1$ to $D_2$ is increased (exaggerated) exponentially rather than linearly. This exaggeration is achieved by using sensor beams which are not perpendicular to the plane the coin rolls along. Referring to FIG. 4, by positioning the light beams 160 and 161 at angles, the apparent distance measurements become exaggerated. Controlling the angle of the light beams, the measurements can be exaggerated so that the $D_1$ measurement is greater than that obtained using perpendicular beams, while $D_2$ is smaller than that obtained using perpendicular beams. The resultant ratio of $D_1/D_2$ is substantially increased relative to the ratio obtained using perpendicular beams.

The degree of amplification is determined strictly by the choice of beam angles and the distances between the beams. The analysis of the choice of beam angles and distances is made in reference to FIGS. 5 and 6.

Figure 5:
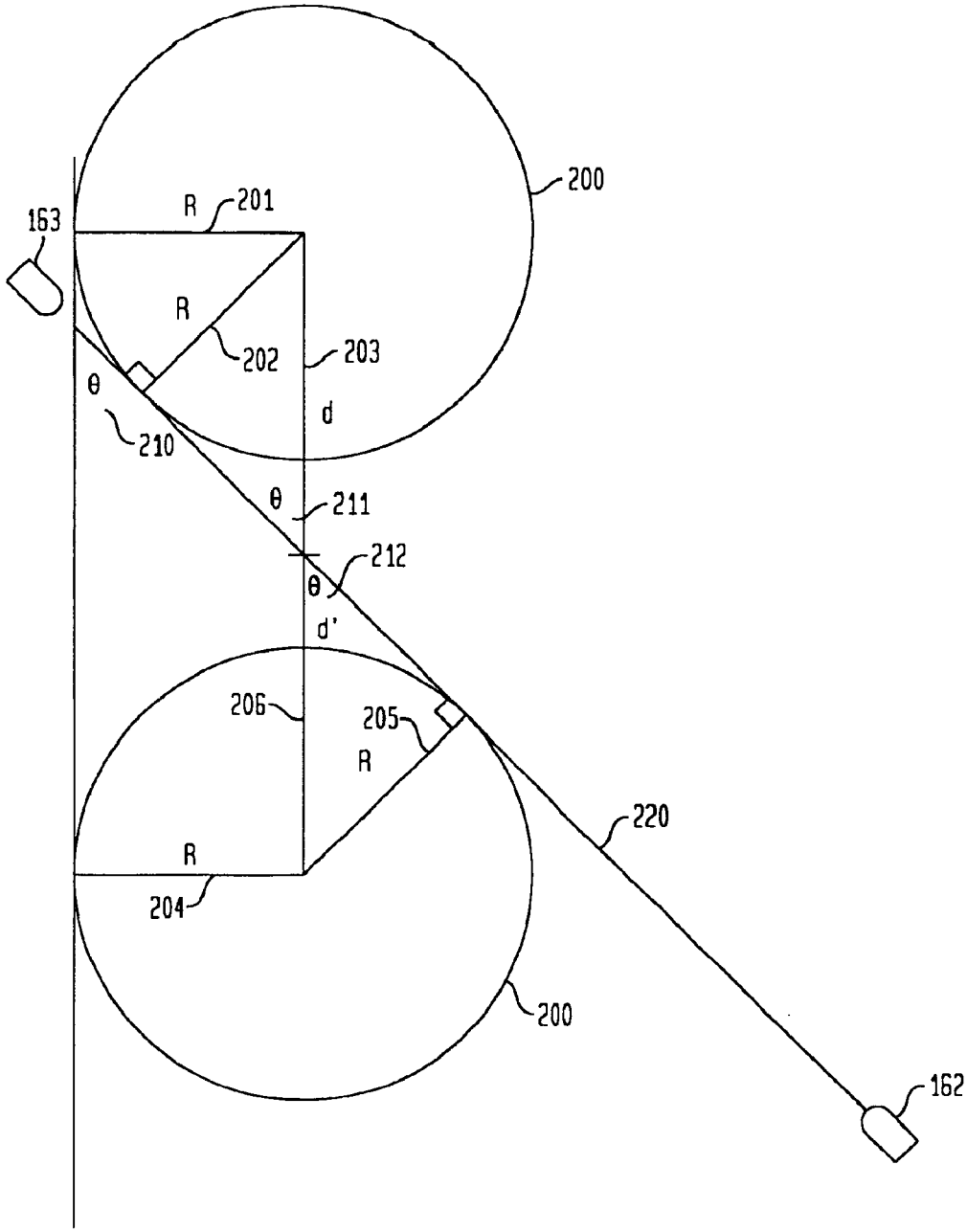
FIG. 5 shows an expanded view of the optical diameter measurement system used in the optical exaggeration technique of the current invention to determine the diameter of a coin before normalizing for speed.

Referring first to FIG. 5, the configuration of the exaggerated coin diameter measurement can be seen. The transmitter—receiver pair 160 as shown in FIG. 4 and using transmitter 163 and receiver 164 in FIG. 5, form the beam 220 and the angle θ 210 with respect to the coin ramp as shown in FIG. 5. A coin 200 of radius R is shown first just approaching the beam, as indicated in the upper portion of FIG. 5. The coin 200 will be tangent to the ramp as shown by the perpendicular radius R 201 as well as tangent to the beam 220 at the point shown by R 202. The same coin 200 is shown in the lower portion of FIG. 5 just exiting the light beam 220 with its radius 205 perpendicular to the beam 220 and its radius 204 perpendicular to the coin ramp. Using basic geometric theorems it can be shown that the angles θ 211 and θ 212 are both equal to the angle θ 210. Using the definition of the trigonometric function SIN θ gives us the equation:

$$\text{SIN } \theta = R/d$$

Where R=the radius of the coin being measured d=the distance from the center of the coin to the intersection of the beam, measured parallel to the coin path.

Similarly, it can be shown that the distance d' from the center of the coin to the intersection of the beam when the coin 200 has just passed the light beam 220 is:

$$\text{SIN } \theta = R/d'$$

Therefore, d=d', and the total distance traveled by the coin is 2 d.

since d=R/SIN θ, 2 d=2R/SIN θ.

Or, the distance traveled by the coin $D_{(coin\ start\ to\ end)}$= 2R/SIN θ

This coin distance traveled reduces to 2R when the angle θ is 90°, which is when the light beam is perpendicular to the coin path. An angle less than perpendicular results in an exaggerated distance greater than the actual diameter of the coin.

Figure 6:
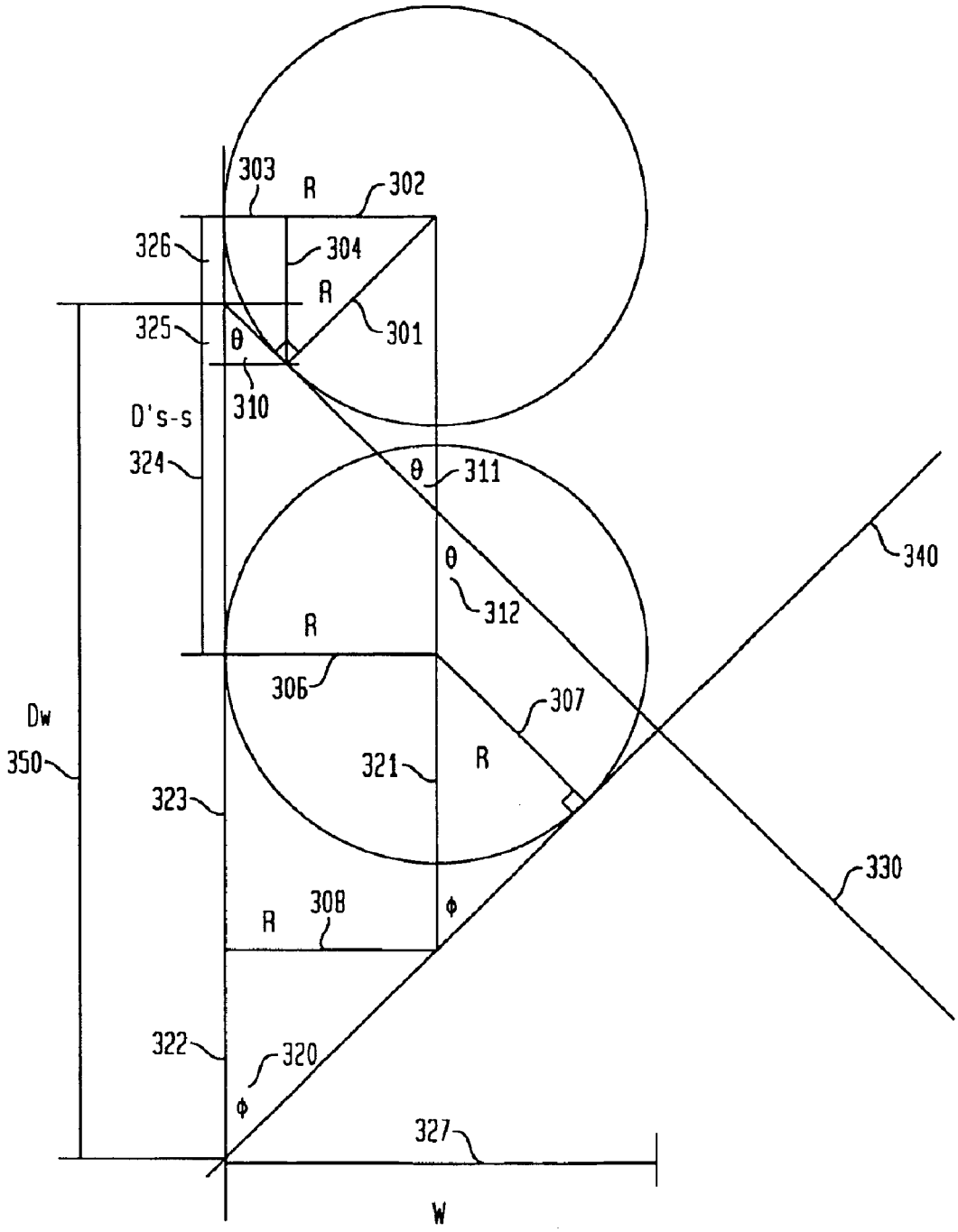
FIG. 6 shows an expanded view of the optical diameter measurement system used in the optical exaggeration technique of the current invention to determine the speed normalized exaggerated diameter of the coin.

Referring now to FIG. 6, a similar analysis can be used to determine the distance traveled by a coin from the point of entry to the first light beam 330 to the point of entry to the second light beam 340. In order to address the most general case, the beam angle of the second beam may 340 be different from the angle of the first light beam 330. Note in FIG. 6, θ 310 is used to denote the angle beam 330 makes relative to the coin path, while Φ 320 is the angle beam 340 makes relative to the coin path. The distance between the coin path and the intersection of the two light beams 330 and 340 is given by distance W, or line segment 327.

The distance the coin must travel from the start of the first light beam 330 to the start of the second light beam 340 is shown by D's-s 324. This distance can be determined again using geometry and trigonometry.

D's-s=Dw−line segment 322−line segment 323−line segment 325+line segment 304

Line segment 321 can be shown to be R/SIN Φ which is equal to line segment 323.

Line segment 322 can be shown to be R/TAN Φ

Line segment 304 can be shown to be R SIN θ

Line segment 302 can be shown to be R COS θ and line segment 303 is R−RCOS θ

From this line segment 325 can be shown to be (R−RCOS θ)/TAN θ

Finally, by using trigometric equivalents, it can be shown that Dw 350 can be shown to be W/TAN θ+W/TAN Φ

By substitution, the distance D's-s 324 can be shown to be:

$$D's\text{-}s = W/\text{TAN } \theta + W/\text{TAN } \Phi - (R/\text{TAN } \theta + R/\text{TAN } \Phi) + \text{RCOS}^2\ \theta/\text{SIN } \theta + \text{RSIN } \theta - R/\text{SIN } \theta$$

As a simplifying assumption, let θ=Φ=45°

$$D's\text{-}s = 2(W-R)$$

It is worth noting, this distance measuring the start of the first beam to the start of the second beam distance is a number which decreases as the coin radius increases.

To once again normalize the velocity out of the equations the relationship developed earlier is still valid:

$$D_1/D_2 = t_2/t_1$$

Where $D_1 = D_{(coin\ start\ to\ end)}$=2R/SIN θ, or 2√2 R, for 45°

$D_2$=D's-s=2(W−R)

Or $D_1/D_2$=2√2 R/2(W−R)=√2 R/(W−R)=$t_2/t_1$

As shown earlier, the numerator, $D_1$ is exaggerated or bigger than the radius of the coin being measured, while the denominator $D_2$ is smaller as the radius of the coin increases. This results in a very exaggerated ratio disproportionately larger as the radius of the coins increase. FIG. 8 shows a table 800 illustrating the impact of this new improved sensing arrangement compared to measuring diameters using perpendicular beams. The perpendicular beams yields coin diameter ratios equivalent to the ratios of the coin diameters being measured. The angled beams result in coin ratios that are substantially improved. It should be clear that the distance selected for $D_2$ in the prior art is not a factor in determining the ratio of diameters of the coins. In the data representing the current invention, this $D_2$ is a significant factor in the ratios obtained. Whereas the ratios of dimes to pennies is about 1.06 using the actual coin diameters as well as the measured values using perpendicular beams, this same ratio grew to 1.14 using the inventive technique described herein.

Insofar as coins of largely different diameters need to be considered, there are practical limitations to the exaggeration that can be achieved. These limitations include the available path length for the measurement system, the minimum and maximum coin diameters to be measured, the mechanical constraints for sensor positioning and the like. In a presently preferred embodiment of the current invention, the angles of the two light beams are 45°. The distance of the beams are set so that the intersection of the beams are approximately 0.7" or 17.8 mm from the coin path. The cross point of the light beams must be greater than the radius of the largest coin being measured to ensure the measured distance from arrival at the first beam to the arrival at the second beam is a positive number. Since the beams cross, it would be possible to enter the second beam before the first beam if the coin radius was greater than the distance of the crossover point to the coin path. Referring to FIG. 8, a number of different beam cross over points are shown. When W (the distance between the coin path and the intersection of the light beams) is less than the coin radius, as shown when W=12.7 (less than the radius of the dollar), the ratio using that coin becomes negative. Increasing the distance W decreases the sensitivity while requiring more mechanical space. The 45 degree angles and a W of 17.8 mm appear to be a reasonably optimized set of parameters.

Figure 7A:
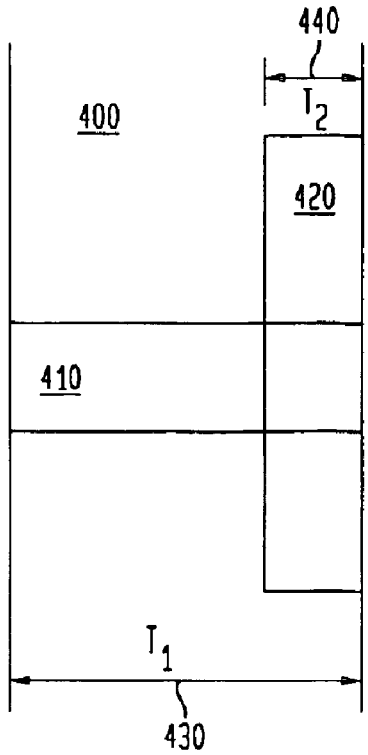
FIG. 7A shows an edge view of the coin in the coin path to describe the thickness measurement without using the optical exaggeration method of the current invention.

Referring now to FIG. 7A, the profile of a coin channel 400 is shown with a coin 420 positioned midway through a light beam 410. Without the coin in place, the light transmitted from the LED 162 (as shown in FIG. 4) is partially masked by the mechanical channel 164 and 165 to form the light beam 410. The light beam is then received by the phototransistor 163. The "masking" may be suitably performed by channels or slots in a plastic member housing the LED 162 and phototransistor 163, as described in greater detail below. This received light is used in the feedback circuit discussed later to set the closed loop gain of the system. Additionally, this no coin present light can be processed through an analog to digital converter to obtain a reference magnitude of the received light. Given $T_1$ as the depth 430 of the coin channel 400 as shown in FIG. 7A, the amount of light received over this depth can be determined. When the coin 420 having a thickness 440 ($T_2$) comes into the light beam, depending on its thickness, it will block some portion of that light. The resultant analog to digital converted magnitude of this new received light with respect to the magnitude of the received light without the coin can be used to determine the coin thickness. The light received will be a measured voltage (from the analog to digital converter). However, once the ratios are determined, the voltage units are eliminated from the equation, and the resultant calculated values will be units of distance.

$$V_{(no\ coin)}/T_{1(channel\ depth)}=(V_{(no\ coin)}-V_{(coin)})/T_{2(coin\ thickness)}$$

Therefore:

$$T_{2(coin\ thickness)}=T_{1(channel\ depth)}(V_{(no\ coin)}-V_{(coin)})/V_{(no\ coin)}$$

The preferred channel depth $T_1$ is about 3.5 mm. This depth ensures that thick coins can easily pass through the channel, and that bent or distorted coins will not likely jam in the channel. The narrower the channel the more accurate the coin thickness measurement will be.

Figure 7B:
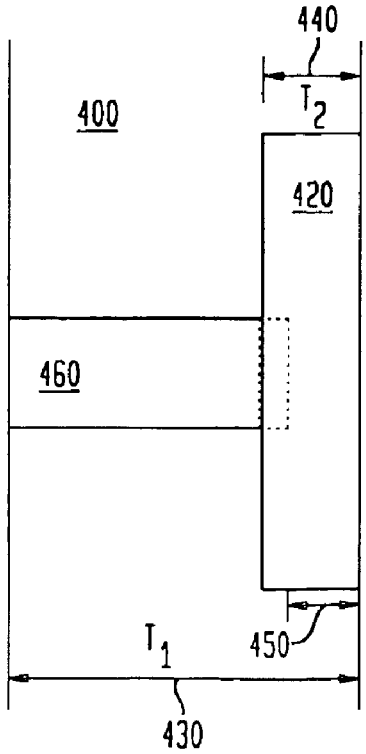
FIG. 7B shows an edge view of the coin in the coin path to describe the thickness measurement using the optical exaggeration method of the current invention.

Referring now to the embodiment of the present invention as shown in FIG. 7B, a light beam 460 is limited so that the full depth 430 of the coin channel is not used. The beam of light is offset by an amount 450 such that the smallest coin of interest, when in place, blocks the beam a smaller amount than in FIG. 7A. Channels 164 and 165 are further restricted, or masked, by the channels such that in the absence of a coin less than the full coin channel height is used by the beam. The coin does not have the same effect proportionally wise when blocking this modified "mask" since a smaller percent of the coin is seen. By way of example, a US dime has a thickness of 1.35 mm. If we allow the offset of the beam to be 1 mm, the dime will only block 0.35 mm of the light beam 460. In this case, the light received in the absence of the coin will again be used to determine a reference magnitude signal. Now, however, when the coin blocks the path, since an offset (in this case equal to 1 mm) exists, the coin will block a smaller percentage of the beam. This will result in an exaggerated thickness separation between coins. The impact of this technique is shown in table 900 of FIG. 9. The separation for all combinations of US coins is substantially increased by present technique. As can be seen in FIG. 9, the actual ratio of thickness for a US dime, by way of example, to that of a US penny is 1.15. Using the technique of the present invention, this ratio is measured as 1.57.

Figure 10A:
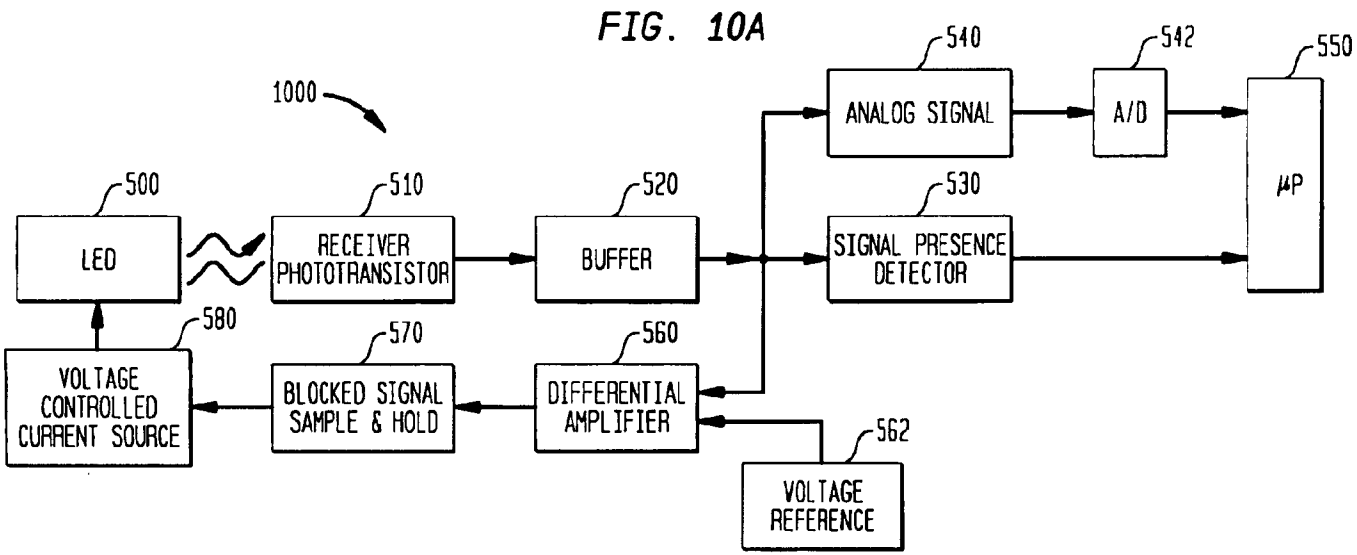
FIG. 10 shows a block diagram of the closed loop feedback system inclusive of the optics of the current invention.

The discussions above relative to the exaggerated diameter measurement and the exaggerated thickness measurements can clearly be obtained using a common sensor set. That is, the two light beams used in the diameter measurement technique disclosed herein can also be used to make the exaggerated thickness measurement. In fact, only one of these two beams is required for the thickness measurement. This can be achieved by using the common sensors to generate both a digital signal for the diameter measurements and an analog signal to make the thickness measurements. Referring now to FIG. 10A, a block diagram of a preferred embodiment of an electronic circuit 1000 which allows both the diameter and thickness measurements to be made with a common sensor set is shown. The circuit configuration shown is for a single sensor set. A duplicate electronic arrangement can be used for the second sensor set as well.

The light beam referred to in both the diameter and thickness measurements can be generated by an LED 500 as shown in FIG. 10A. The receiver, typically a phototransistor 510, receives the light from the LED 500 and generates a signal responsive to this received light. As this signal will be processed in a number of ways, it is good engineering practice to provide an electronic buffer 520 to isolate the relatively high impedance signal generated by the phototransistor 510 from the rest of the electronics. The use of a buffer is well known in the art and any number of technologies such as using a voltage follower op amp configuration will suffice. It should be noted that in addition to the function of buffering the phototransistor signal, circuit gain can be added at this stage if required. In this case, an operational amplifier would serve the dual functions of providing the required buffering and amplifying the signal.

Once buffered, the resultant signal can be digitized to generate a signal by a presence detector 530. Again, the technology to generate a digitized signal is well known in the art and a number of techniques can be used. An example would be to use a signal comparator to compare the received buffered signal 520 to a fixed or signal dependent reference signal. This signal presence detector output will be used to start and/or end the timing for making the diameter measurements of the coin as it is generated when the coin first interrupts the light beam and when it just exits the light beam. FIG. 10A shows the output of the signal presence detector 530 going to a microprocessor 550 or other device capable of timing these signals and calculating the required coin diameters. The microprocessor 550 also provides the means for determining whether the measured diameter is of a coin of interest and is accepted or not.

Again referring to FIG. 10A, the output of buffer 520 which is processed by the signal presence detector 530 is itself an analog signal 540 as described above in the discussion of the thickness measurement This analog signal 540 is therefore connected to an analog to digital converter or alternate means to determine the analog voltage of the signal. The use of various analog to digital techniques is again well known in the art and will not be discussed. However, it is cost effective to choose a microprocessor which includes analog to digital inputs to minimize the product cost. In any case, the microprocessor 550 or other device capable of using the determined analog voltages in the thickness calculation will be used for this purpose.

In order for the results of the various calculations, especially those involving the analog measurements to be consistent over long periods of time, it is important to ensure the light output of the LED 500 and the resultant signal level of the receiver 510 remain constant over time, temperature, and the like. This end is achieved in the current invention by including the optical components in a closed loop electronic circuit. Again referring to FIG. 10A, the signal level of the phototransistor is automatically maintained at a level determined by the voltage reference 562. This is achieved by comparing the output of the buffer 520 phototransistor voltage to the output of the voltage reference 562 using a differential amplifier 560. A suitable choice of differential amplifiers would be an operational amplifier. The difference between the output of the buffer 520 and the voltage reference 562 is amplified by the differential amplifier 560. The amount of amplification is determined by the choice of components, the strength of the signals required, and the like. To ensure a coin in the path of the light does not influence the optical feedback signal, an added circuit block 570 to a traditional closed loop system is required. When the coin blocks the optical signal, the circuit 1000 should ignore this blocked state or else the feedback circuit will try to increase the LED 500 current to allow additional light to be sent to the receiver in an effort to compensate for the blocked light due to the coin. This condition is detected by the blocked signal sample and hold circuit 570 so that the feedback circuit is suspended while a coin is in the path blocking the receiver 510. This function is straightforward to achieve using various techniques known in the art. A presently preferred method is to use a diode to block the sudden signal change due to a coin present condition, and a capacitor to hold the signal that was there previous to the coin blocking the signal. The resultant feedback signal can be used by a voltage controlled current source 580 to adjust the LED 500 output to compensate for long term degradation, temperature variations and the like. The end result of the closed loop optical system is the LED 500 current is increased or decreased to maintain a nominal receiver 510 output equivalent to the voltage reference, or a scaling of this voltage if the buffer includes amplification.

Another advantage of the circuit 1000 described above in combination with the analog voltage measurements made to determine the thickness of the coin, is the ability to detect the presence of a string or tape attached to the coin in an effort to cheat the coin acceptor. The string or tape used will result in an analog reading on the thickness measuring sensors which is different from the reference analog measurement made before the coin entered the sensor path. The sensitivity of the system allows for even very thin or clear tape or string to be detected. An additional means for defending against the use of strings or tape is described below relative to the techniques of the present invention.

Figure 10B:
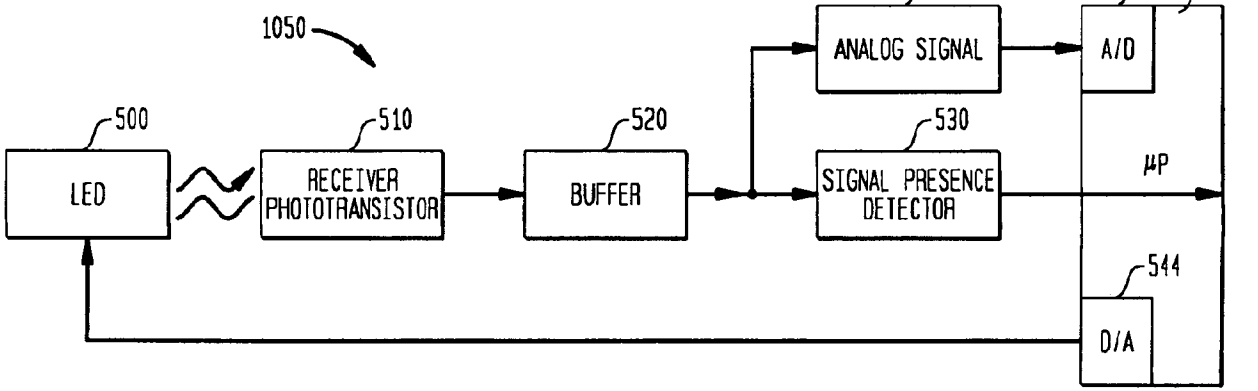

It should be clear that the closed loop system described above can be achieved alternatively by using the firmware to replace most of the hardware as illustrated in FIG. 10A. As shown in FIG. 10B, a microprocessor closed loop feedback system 1050 will provide an equivalent solution. Elements 500, 510, 520, 530 and 540 of the system 1050 operate generally as described above in relation to FIG. 10A. As shown, a microprocessor 551 contains or interfaces to an analog to digital converter 543 and a digital to analog converter 544. This digital to analog converter 544 is used to control the current to LED 500. In this case, the voltage reference 562 as shown in FIG. 10A is not required and instead a software control reference is maintained by the system firmware. This approach has the added advantages of lower cost and fewer components.

Figure 2:
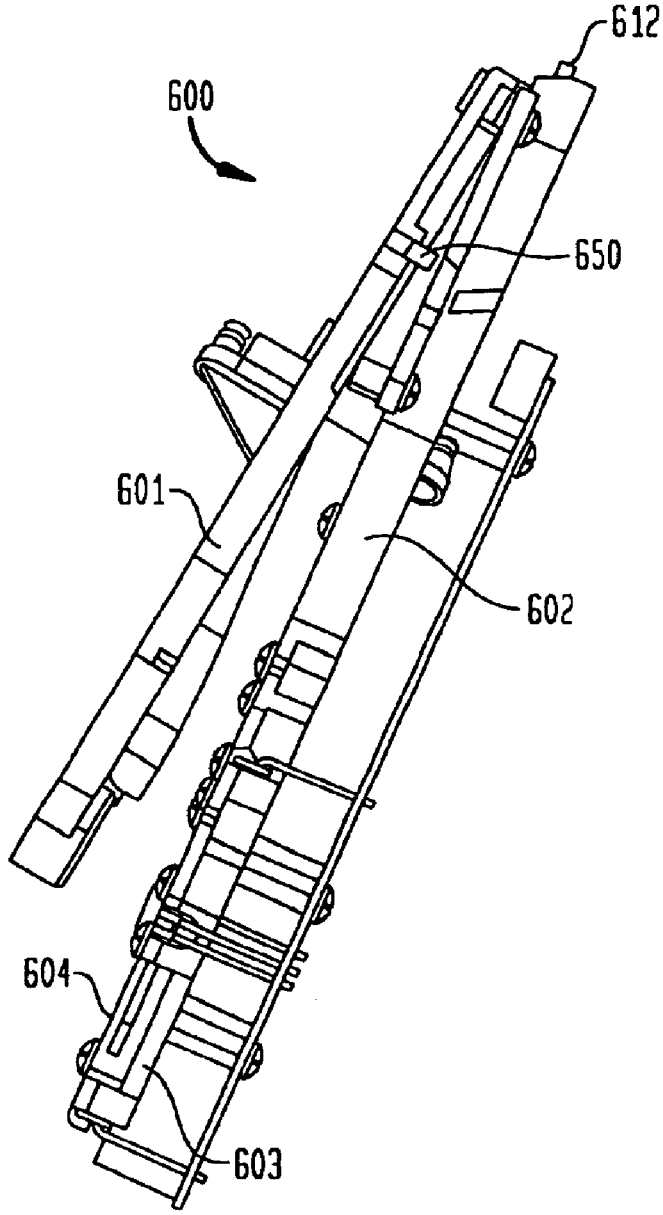
FIG. 2 shows a front view of the coin chute of a preferred embodiment of the present invention with the coin lid open.
Figure 11:
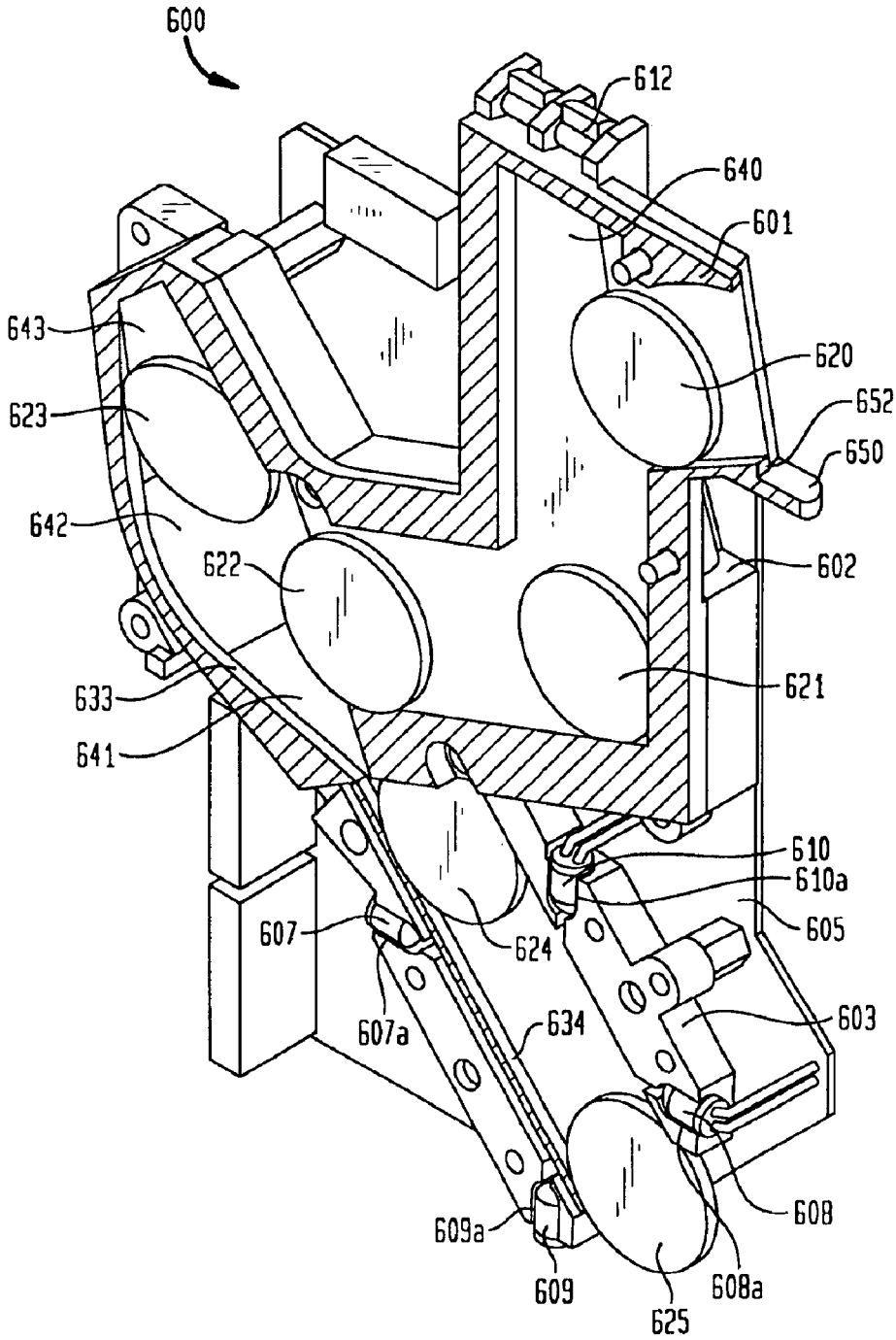
FIG. 11 illustrates a cutaway side view of the coin chute of the current invention showing coins in various positions along the coin path.
Figure 12:
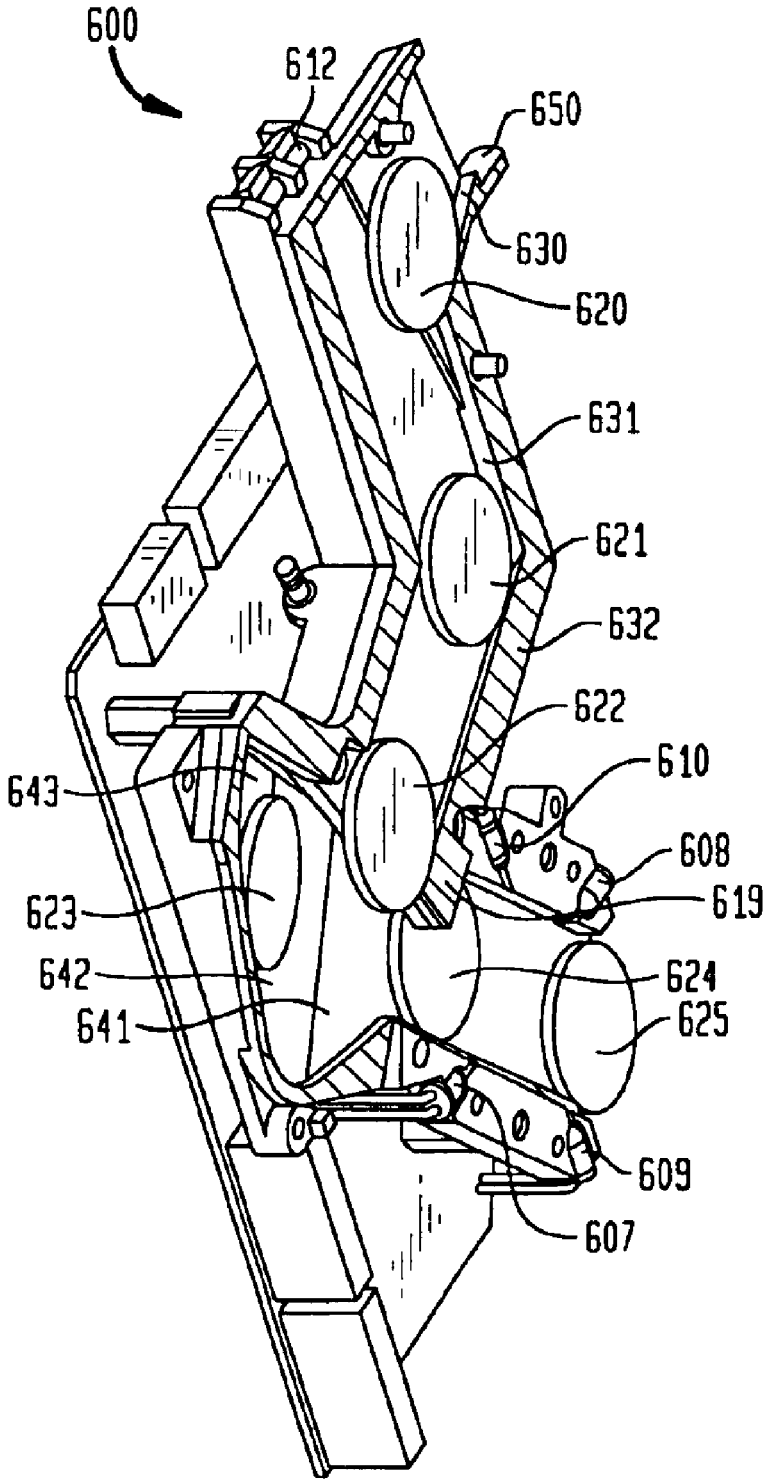
FIG. 12 illustrates a second cutaway view of the coin chute of the current invention showing coins in various positions along the coin path.

Referring now again to FIG. 1, the mechanical configuration of a preferred embodiment of the present invention is shown. The coin chute assembly 600 includes the mechanical coin chute and the electronics controller. As discussed earlier, one aspect of the current invention is the control of the coin to ensure it rolls smoothly past the optical sensors. The coin chute consists of an upper cover 601, an upper slide 602, a lower slide 603, and a sensor cover 604. Additional components are included and will be discussed later. The coin chute is shown mounted to the control electronics board 605 as an assembly. The upper cover 601 and upper slide 602 are interconnected with a hinge arrangement 612 as best seen in FIGS. 11 and 12. This arrangement allows oversized coins, foreign objects, or bent coins to be cleared from the coin chute by moving coin clearing tab 650. The upper cover 601 and upper slide 602 are biased together by spring 606. FIG. 2 shows the separation of upper cover 601 and upper slide 602. A small angle at tab 650 allows sufficient separation between these parts to release jams coins.

Referring now to FIGS. 11 and 12, a coin 620 is deposited at the coin entry slot above the coin clearing tab 650. The coin chute is intended to be mounted at an angle of about 25° from the vertical as shown in FIG. 2. Thus the coin rides on the surface 640 of the upper slide 602 as shown in FIG. 11. The rolling surfaces 630, 631, 632, however are part of the upper cover 601. Thus, when the coin clearing tab 650 is pushed thereby opening the coin chute, the coin riding surface moves out from under the coin allowing the coin to drop. As can also be seen in FIG. 11, a short interference wall 652 is provided at the coin entry area to prevent the user from inserting the coin with a spin or excess energy which may cause unusual bouncing. Spin would otherwise be achieved by resting the coin between the user's finger and a rest such as the coin clearing tab 650, a fast downward shove would cause the spinning affect. The wall 652 prevents this from being successful.

Generally, the incoming coin 620 rolls on ledge 630 and falls onto ledge 632 as seen in FIG. 12 at coin 621. Ledge 632 has a slope associated with it in a preferred embodiment to help ensure the coin rests on the upper slide 602 surface 640. This slope aids in transferring the energy the coin has as a result of its drop to the surface 640. The coin 621 then rolls along this sloped edge 632 to the position shown by coin 622. At this point the coin will be exiting the upper slide 602 and falls to the lower slide 603. The momentum of the coin as shown by coin 622 causes it to hit the ramp 633 shown in FIG. 11 while continuing in a direction toward the position shown by coin 623. The surface of the lower slide 603 has several planes as shown by planes 641, 642 and 643. While the coin 623 is carried by its momentum along rail 633, it also travels along the increasing plane similar to an emergency truck stop slope on a highway. The coin rides up the increasing slopes from slope 641 to slope 642 and possibly to slope 643. While moving along this direction, the coin is also traveling in a direction opposing gravity. The combination of gravity and the frictional surfaces including the ramp 633 and the slopes 641, 642, and 643 causes the coin to lose all its energy and come to a full stop. The slopes 641, 642, and 643 now with the aid of gravity start the coin rolling again, this time down the ramp 633. Since the coin has now started from a stopped position, it can be controlled to roll smoothly along the ramp 634 past the sensors 607, 608, 609, and 610 with a controlled velocity. In a preferred embodiment, the ramp 634 is positioned at a 45 degree angle.

The velocity is controlled by keeping the coin rolling smoothly on the coin path and measuring the various times over a short distance. If there is any acceleration, it becomes a minor error term over short distances. Since the present technique measures a change in distance over a relatively short distance relative to the total distance the coin travels from its rest point at the top of the ramp, this measurement is a dD/dt measurement. Even in free fall, the acceleration under these conditions can be approximated by a linear curve or average velocity the error term decreasing as the distance of interest shrinks relative to the total fall distance. In the present case, the present technique further minimizes the error term since the coin ramp on this final descent is on an angle of about 45 degrees. Geometry shows the cosine of 45 degrees to be 0.707 times the affect of gravity on our coins. Also, as seen in FIG. 11, and discussed above, the entire chute is on an angle of about 25 degrees from the vertical which introduces a frictional component of the coin rubbing against the plane made up of part 603. This angle and the coefficient of friction between the coin and the plane 603 further offsets the impact of acceleration due to gravity. While the presently disclosed angles described above were experimentally determined to give the best compromise to keep the coin rolling at a relatively constant velocity, other angles may be utilized without departing from the teachings of the present invention.

As shown in FIG. 12, the coin path the coin 624 travels when it is passing the sensors is along a different plane than it started when at position of coin 622. Although the coin transverses from upper slide 602 to lower slide 603, the rail it rolls along is part of the upper cover 601 until the coin 624 rides along the path to the sensors 607, 608, 609, and 610. The coin now rolls along rail 634 which is part of the sensor cover 604. The optical sensors are positioned within the lower slide as shown in FIGS. 1, 2, 11 and 12. These sensors are positioned by the lower slide and sensor cover to allow for the correct alignment and angles as discussed in detail above. The alignment of the respective pairs of sensors 607, 608 and 609, 610 is primarily determined by slots 607*a*, 608*a*, 609*a* and 610*a* in the lower slide 603 into which the sensors 607, 608, 609 and 610, respectively, are disposed. Additionally, the depth of these slots is used in the current invention to achieve the exaggerated thickness measurements discussed in detail earlier. For example, as shown in FIG. 7B, decreasing the depth of the slots results in the light beam 460 having decreased width. To ensure the coins do not bounce over the slots that the sensor signals require, the sensor cover 604 contains the rail 634. This sensor cover 604 is made of an optically clear material allowing the optical signals to pass without impact while providing the continuous rail 634 required to keep the coin 624 rolling uniformly past the sensors. The sensor cover 604 provides the ledge upon which the coins roll, ensuring the mechanical slots, or masks, do not cause the coins to bounce.

The method of ensuring the energy is removed from the coin by having the coin travel through at least two planes also provides a passive means for preventing cheating the coin chute by using strings, tape and the like. Coins held on a string will not be able to be returned through the entry point, as once the coin is past the first travel plane 640 in FIG. 12 and heading toward the sensors on the second travel plane 641, the coin is already prevented from being pulled back as the string or tape will be caught trying to pull the coin back up over the ledge created by the upper cover at 619.

Referring to FIG. 1, the sensor cover 604 can be seen to have a slot 615 along the coin path. The upper cover 601 has an appendage 611 which will be located within the slot 615 when the upper cover is in its normal closed position. The appendage 611 has a recess into which a magnet is mounted. The purpose of the magnet and the positioning of the magnet are to provide a means to eliminate magnetic materials that might otherwise be accepted as valid coins. The magnet would not be used if the valid coins are magnetic. If a magnetic coin is put in the coin chute, it would pass just under the magnet mounted in appendage 611. Since the appendage 611 and magnet essentially lie just above the coin path and is positioned so that any coin passes beneath it, magnetic coins will be stopped by the magnet. The coins will be held such that they have already intercepted the first sensor path created by sensors 607 and 608. Per the discussion earlier, the expected timing based on coins moving with constant velocity would not be realized. The coin will be seen to have entered the path and not left the path. The system will be programmed to reject these coins and send a signal to alert the user to push the coin clearing tab. When this tab is pushed and the upper cover separates from the upper slide, the appendage 611 will separate from the sensor cover 608. The coin will be held by the sensor cover 608 as the magnet is retracted, thus the magnet will lose its hold on the coin and the coin will fall through. Thus with the addition of a magnet and no additional sensors or electronics, the category of magnetic materials can be rejected. It should be clear that even in the event the magnet does not stop the coin completely, the resultant reduction on velocity will cause the determination of the coin diameter to be erroneous and the coin will not be credited as a valid coin.

It should be clear that the coin chute described herein can be further modified to allow for the return of coins that were not accepted. The preferred embodiment described keeps all coins submitted to the coin chute and only gives credit for coins determined to be valid. Keeping all submitted coins further provides disincentives for people who are attempting to insert foreign coins or even slugs as they will lose these without credit. In the event a coin is occasionally accepted as a valid coin, the percentage of the time this coin is accepted multiplied by the actual value of the coin will determine whether continued slugging should be attempted. By way of example, if Canadian quarters are inserted in the coin chute which is set to accept only US quarters, some coins may be falsely accepted as valid. This is true since Canadian quarters are manufactured to the same diameter and thickness as US quarters. There are some Canadian quarters made years ago that were not magnetic. Therefore, even if 50% of Canadian quarters are accepted as US quarters, it is not worth feeding Canadian quarters into the unit in the hopes of receiving credit for a US quarter which is worth about 13% more than the Canadian quarter. Since the Canadian quarters that are not credited will not be returned, the risk exceeds the rewards in this cheat attempt. This will quickly discourage users from attempting to cheat the coin chute of the current invention.

In an alternate embodiment of the present invention, the first sensing beam may be replaced by a device which halts the coin's progress and then releases it. A single light beam is located at a predetermined distance from the halting device. As described above, the time required for the coin to reach and traverse the light beam is determined. If the distance traveled by the coin from the halting device to the intersection of the coin with the light beam is known for the given coin type, the coin may be identified.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

We claim:

1. An electronic coin acceptor for testing coins comprising:

a coin chute defining a plane of coin travel, the coin chute having a corn track on which a coin to be tested rolls on its edge;

two optical transmitter and receiver pairs disposed relative to the coin chute to create two sensing beams in the plane of coin travel for sensing the coin to be tested as the coin passes through said beams as it rolls along the coin track, at least one of said pairs of transmitters and receivers being disposed so that at least one of said beams is angled at a nonperpendicular angle to the coin track to cause exaggeration of a diameter measurement of the coin to be tested.

2. The electronic coin acceptor of claim 1 wherein both of said pairs of transmitters and receivers are disposed so that both of said beams are angled at nonperpendicular angles to the coin track.

3. The electronic coin acceptor of claim 1 wherein said beams intersect at a predetermined distance above the corn track.

4. An electronic coin acceptor for testing coins comprising:

a coin chute defining a plane of coin travel, the coin chute having a coin track on which a coin to be tested rolls on its edge;

at least two optical transmitter and receiver pairs disposed relative to the coin chute to create at least two sensing beams in the plane of coin travel for sensing the coin to be tested as the coin passes through said beams as it rolls along the coin track, at least one of said pairs of transmitters and receivers being disposed so that at least one of said beams is angled at a nonperpendicular angle to the corn track to cause exaggeration of a diameter measurement of the coin to be tested; and means for identifying the coin by timing the traversing of one of said beams by the coin and determining a time period during which the coin rolls from a position relative to a first sensing beam to a position relative a second sensing beam.

5. The electronic coin acceptor of claim 4 wherein at least two of said pairs of transmitters and receivers are disposed so that at least two of said beams are disposed angled at nonperpendicular angles to the coin track.

6. The electronic coin acceptor of claim 5 wherein the at least two beams intersect at a predetermined distance from the coin rolling surface.

7. The electronic coin acceptor of claim 6 wherein the predetermined distance is greater than the radius of a largest coin to be identified.

8. The electronic coin acceptor of claim 4 further comprising a closed loop feedback circuit to control the strength of the sensing beams.

9. The electronic coin acceptor of claim 4 further comprising a magnet mounted above the coin track.

10. The electronic coin acceptor of claim 9 wherein the magnet stops magnetic objects.

11. The electronic coin acceptor of claim 10 further comprising a movable portion, and wherein said magnet is attached to the movable portion such that when the movable portion is moved a captured magnetic object is released from said magnet.

12. The electronic coin acceptor of claim 1 wherein said nonperpendicular angle is approximately 45°.

13. The electronic coin acceptor of claim 1 wherein said coin chute is designed to insure that the coin to be tested rolls past said pairs of transmitters and receivers at a relatively constant velocity.

14. The electronic coin acceptor of claim 1 wherein at least one optical transmitter from the two optical transmitter receiver pairs is offset to create an offset sensing beam to exaggerate a thickness measurement of the coin to be tested.

15. The electronic coin acceptor of claim 3 wherein the predetermined distance is approximately 0.7 inches.

16. The electronic coin acceptor of claim 4 wherein at least one optical transmitter from the two optical transmitter receiver pairs is offset to create an offset sensing beam to exaggerate a thickness measurement of the coin to be tested.

17. The electronic coin acceptor of claim 5 wherein said nonperpendicular angle is approximately 45°.

18. The electronic coin acceptor of claim 5 wherein the predetermined distance is approximately 0.7 inches.

* * * * *